United States Patent [19]

Wilson et al.

[11] Patent Number: 4,709,756

[45] Date of Patent: Dec. 1, 1987

[54] STEAM GENERATOR TUBE SUPPORT

[75] Inventors: Robert M. Wilson, Plum Boro; Robert M. Wepfer, Wilkinsburg, both of Pa.

[73] Assignee: Westinghouse Electric Corp., Pittsburgh, Pa.

[21] Appl. No.: 670,773

[22] Filed: Nov. 13, 1984

[51] Int. Cl.[4] ..... F28F 9/00

[52] U.S. Cl. ..... 165/162; 122/510; 165/159

[58] Field of Search ..... 122/510; 165/162, 172; 248/68.1

[56] References Cited

U.S. PATENT DOCUMENTS

| | | | |
|---|---|---|---|
| 1,992,504 | 2/1935 | Penniman . | |
| 2,805,049 | 9/1957 | Katholi | 165/162 |
| 3,589,438 | 6/1971 | Boorman . | |
| 3,841,272 | 10/1974 | Mayer et al. | 165/159 X |
| 3,940,314 | 2/1976 | Knodler et al. | 326/442 |
| 4,120,350 | 10/1978 | Norton | 165/162 |
| 4,204,305 | 5/1980 | Norton . | |
| 4,285,396 | 8/1981 | Schwoerer et al. | 165/162 |
| 4,576,228 | 3/1986 | Glatthorn | 165/162 |

FOREIGN PATENT DOCUMENTS

| | | | |
|---|---|---|---|
| 2339364 | 2/1975 | Fed. Rep. of Germany | 165/162 |
| 2642521 | 3/1978 | Fed. Rep. of Germany . | |
| 3136865 | 3/1983 | Fed. Rep. of Germany | 165/162 |
| 2086289 | 4/1971 | France . | |
| 149962 | 11/1979 | Japan | 165/162 |
| 1400267 | 7/1975 | United Kingdom . | |
| 807030 | 2/1981 | U.S.S.R. | 165/162 |

*Primary Examiner*—Albert W. Davis, Jr.

[57] ABSTRACT

A tube support plate is disclosed for supporting a plurality of tubes with reduced vibration in a nuclear steam generator. The support plate has a plurality of holes disposed therethrough in a regular array. Each hole has an axis, an interior surface and a plurality of lands supported on the interior surface and extending towards the axis. The support plate has a given thickness as taken along the hole axis, and each of the lands has a tapered surface for facilitating tube insertion. The method of forming the tube support plate comprises a first step of forming each of the holes through the support plate with a first cylindrical portion of a first diameter and a second cylindrical portion of a second diameter less than the first diameter. Next, portions of the second cylindrical portion are removed in a second step to form a plurality of lands having exposed ends supporting a tube within the hole.

5 Claims, 6 Drawing Figures

FIG. 1.
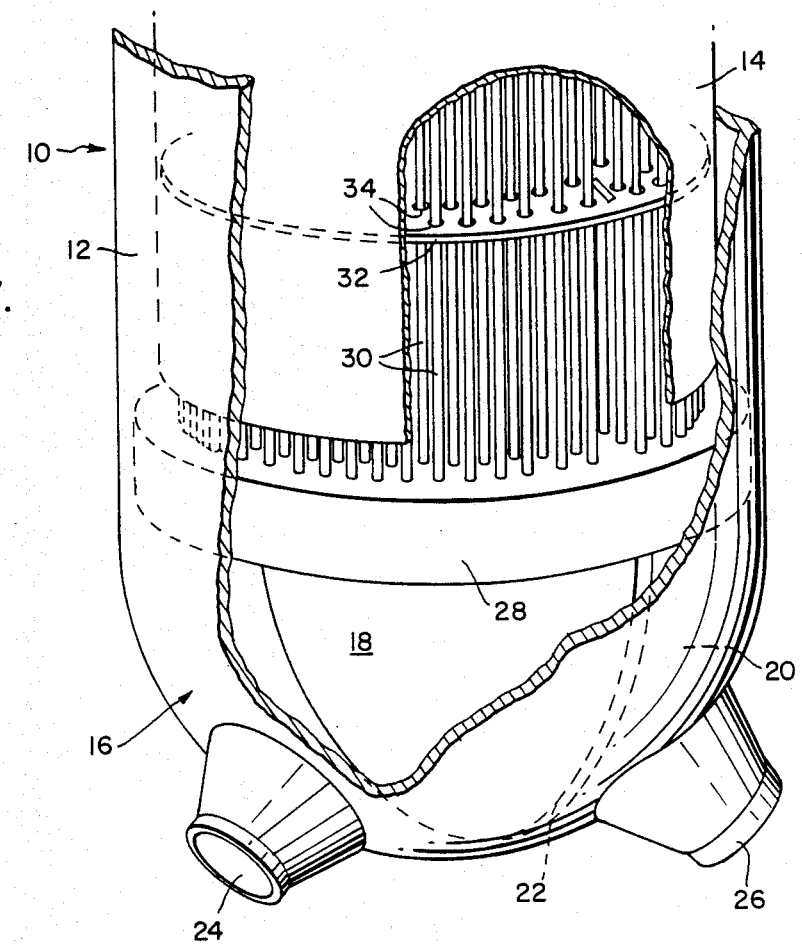
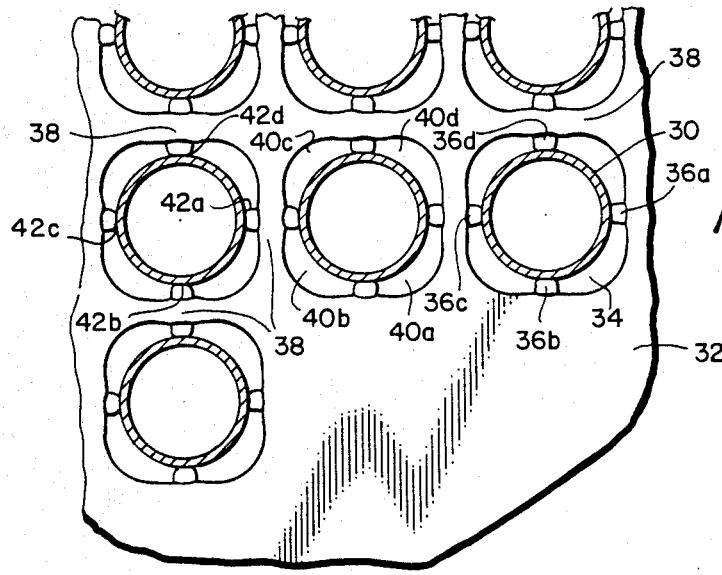
FIG. 2

STEAM GENERATOR TUBE SUPPORT

BACKGROUND OF THE INVENTION

1. Description Of The Prior Art

This invention relates to apparatus for supporting the tubes of a nuclear steam generator to inhibit vibration and, more particularly, to such apparatus that permits the ready insertion of the tubes, while providing improved support and extended life of the tubes.

2. Reference to Related Application

Cross reference is made to co-pending application Ser. No. 490,060 now U.S. Pat. No. 4,570,883, filed on Apr. 29, 1983 in the name of this inventor and entitled TUBE SUPPORT GRID.

2. Description Of The Prior Art

A nuclear steam generator 10 of the type found in the prior art is shown in FIG. 1 of the attached drawings, as comprising a bundle of a large number of vertically orientated U-shaped tubes 30. The tubes 30 are disposed in a lower, cylindrically shaped shell 12 of the steam generator 10, whose bottom end is associated with a primary coolant plenum or channel head 16, typically of a hemi-spherical configuration as shown in FIG. 1. The channel head 16 bis divided by a partition 22 into a first half typically known as a hot leg 18, and a second half typically known as a cold leg 20. High-temperature primary water from a nuclear reactor is introduced into the steam generator 10, through a primary inlet 24 into the hot leg 18. The primary water passes from the hot leg 18 into the exposed openings of the plurality of U-shaped tubes 30, flows through the tubes 30 to be introduced into the cold leg 20, and finally, exits from the steam generator 10 through a primary outlet 26.

Opposite ends of the U-shaped tubes 30 are mounted within a tube sheet 28 in communication with the hot leg 18 and the cold leg 20, respectively. A wrapper 14 surrounds the bundle of U-shaped tubes 30. In FIG. 1, a part of the wrapper 14 is broken away to show one of a plurality of tube support plates 32. It is understood that the other tube support plates 32 are disposed above the illustrated plate and in parallel relationship thereto to support the bundle of tubes 30 in a manner to inhibit vibration induced by the secondary water circulating through the steam generator 10.

As shown in FIG. 1, the tube support plate 32 has a plurality of tube holes 34 disposed therethrough, each for receiving a tube 30. The secondary water circulating within the steam generator 10 and, more particularly, faulted conditions of feedline and steamline breaks imposes a load on the tube support plate 32. The load handling capability of the tube support plate 32 is dependent upon its thickness and, in turn, upon the area of that section taken between the tube openings 34. Tube support plates of the prior art have been thickened to increase their load handling capacity. However, the ease of inserting the tubes 30 through their corresponding openings 34 is related to the thickness of the tube support plate 32. As the thickness of tube support plate 32 increases, the ease of inserting the tubes 32 therethrough decreases, thus necessitating an increase in the diameter of the tube holes 34 and, in particular, the diametral clearances between the tube holes 34 and the tubes 30. However, increasing the diametral clearances has a direct, negative effect on tube vibration and the expected life of the tubes 30. If the tubes 30 are permitted to vibrate with respect to their tube holes 34, their exterior surfaces will begin to wear and scar. Eventually, tube vibration will wear through the walls of the tubes 30 causing the primary water circulating therethrough to leak into the steam generator 10, eventually escaping to the turbine generator (not shown).

Tube support plates of the prior art are also subject to dry out or vapor blanketing at the area of contact between the tubes 30 and the tube support plate 32. Contaminants in the secondary water tend to collect at the contact areas between the tubes 30 and the tube support plate 32. The contaminants build-up at the contact areas tending to corrode and to weaken the tube walls. The combination of tube corrosion and vibration eventually leads to tube leakage.

The contact areas between the tubes 30 and the tube support plate 32 tends to be hot with respect to the surrounding environment, noting the direct contact of the support plate 32 with the tubes and the high temperature primary water passing therethrough. The secondary water circulating in the steam generator 10 tends to dissipate this heat if it is permitted to flow directly about the contact areas. However, fine particles of magnetite formed at the relatively high temperatures within the circulating secondary water tends to collect and build-up sludge patches about the tube openings 34 and, in particular, the contact areas 42, thus preventing the secondary water direct access to the contact areas and the dissipation of heat therefrom. As the sludge patches build-up, the vaporization occurring at the contact areas is not washed away by the circulating secondary water, thus, leading to dry out and corrosion of the contact areas. It is desired to decrease the sludge patches, whereby the distance between the center of the sludge patch to the wetted regions of the tubes is shortened. Removal of the sludge patches will increase heat transfer in the contact areas 42 and lower the available superheat at the center of the contact areas between the tubes 30 and the tube support plate 32. By lowering the temperature of the contact area and preventing vapor blanketing, corrosion of the contact area may be inhibited and the tube life extended.

SUMMARY OF THE INVENTION

It is therefor an object of this invention to retard the corrosion of steam generator tubes and, thereby, improve their life.

It is a more specific object of this invention to increase or maintain the load handling capacity of tube support plates for steam generators, while minimizing the contact areas between the tubes and the support plate and improving the insertability of tubes through the support plate.

It is a still further object of this invention to provide a new and novel tube support plate that retards the build-up of sludge patches about the tube holes within tube support plates, thereby improving the circulation of the secondary water over the tubes and support plate, inhibiting vapor blanketing of the contact areas between the support plate and the tubes, improving heat dissipation from the contact areas and, thus, reducing tube corrosion.

In accordance with the teachings of this invention; there is described a tube support plate for supporting a plurality of tubes with reduced vibration in a nuclear steam generator. The support plate has a plurality of holes disposed therethrough in a regular array. Each hole has an axis, an interior surface and a plurality of lands supported on the interior surface and extending towards the axis. Each land has a contact surface disposed toward the axis for supporting one of the tubes. In a preferred embodiment of this invention, the support plate has a given thickness as taken along the hole axis, and each of the lands has a height taken along the axis less than the given thickness.

The method of forming the tube support plate comprises a first step of forming each of the holes through the support plate with a first cylindrical portion of a first diameter and a second cylindrical portion of a second diameter less than the first diameter. Next, portions of the second cylindrical portion are removed in a second step to form a plurality of lands having exposed ends supporting a tube within the hole. In an illustrative embodiment of this method, the first step may be performed by drilling with a bit having an enlarged portion of a third diameter substantially equal to the first diameter and a restricted portion having a fourth diameter substantially equal to the second diameter. The second step may be performed by broaching selected parts of the second cylindrical portion.

BRIEF DESCRIPTION OF THE DRAWINGS

While the specification concludes with claims particularly pointing out and distinctly claiming the subject matter of the invention, it is believed that the invention will be better understood from the following description taken in conjunction with the accompanying drawings, wherein:

FIG. 1 is a perspective view of a nuclear steam generator including a tube support plate in accordance with the teachings of this invention;

FIG. 2 is a plan, partial view of the tube support plate as generally shown in FIG. 1; and FIGS. 3 and 5 are respectively a plan view of a tube hole through the tube support plate in an intermediate stage of manufacture and a plan view of a tube hole as completed, whereas.

DESCRIPTION OF THE PREFERRED EMBODIMENT

Figure 5:
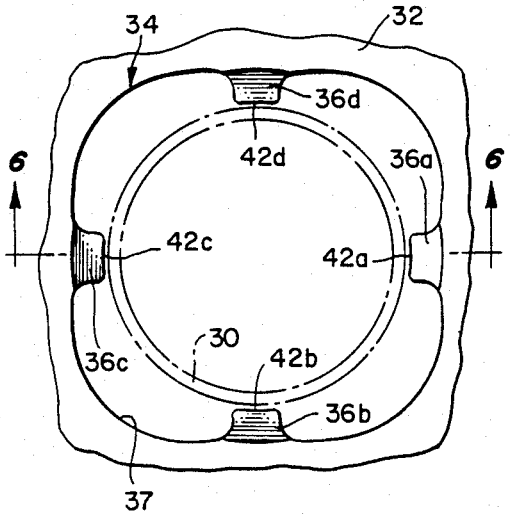
Figure 6:
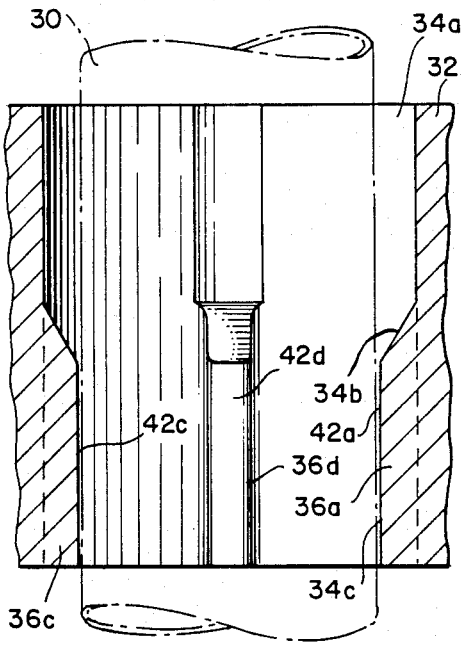

The completed tube support plate 32, as generally shown in FIG. 1, is more fully shown in FIGS. 2, 5 and 6. The tube support plate 32 includes a plurality of tube holes 34 disposed at the intersecting points of a regular grid formed by x and y lines disposed perpendicular to each other. Each tube hole 34 is separated from an adjacent tube hole 34, whether disposed along an x or y line, by a ligament 38 of substantially uniform cross-sectional area. As illustrated in FIG. 2, the ligaments 38 are aligned with the x and y lines of the regular grid to provide improved load handling capability for withstanding seismic loadings. In particular, the ligaments 38 are aligned of each other to form columns running parallel to the x and y lines of the grid, thus providing a tube support structure of improved strength as compared with plates with non-aligned ligaments.

Each tube hole 34 has a plurality of lobes 40*a, b, c* and *d* separated from each other by a like number of lands 36*a, b, c* and *d*. Each land 36 extends from an inner surface 37 toward a central axis of the hole 34 and presents a generally flat contact area 42 facing the hole axis. Each of the lands 36*a, b, c* and *d* has its own contact area 42*a, b, c* or *d*, respectively. The contact areas 42 are those portions of the lands 36 making contact with the tube 30, which is shown in dotted lines in FIGS. 5 and 6.

As best illustrated in FIG. 6, each tube hole 34 has a major or enlarged portion 34*a* and a minor or constricted portion 34*c*, separated by a transition or tapered portion 34*b*. The lands 36 are removed from the enlarged portion 34*a* of the tube holes 34 and extend the length of the constricted portion 34*c* as taken along the hole axis. Each land 36 terminates at its top-most end with its tapered portion 34*b*. Thus as shown in dotted lines in FIG. 6, it is seen that as a leading end of a tube 30 is inserted into the enlarged portion 34*a*, it engages the tapered portions 34*b* of the lands 36, thus directing the tube 30 into and through the restricted portion 34*c*. In the embodiment shown in FIG. 6, the tube support plate 32 is disposed so that the enlarged portion 34*a* is aligned toward the top of the steam generator 10. Noting that the water circulates upwardly through the tube holes 34 of the support plate 32, a further embodiment of this invention contemplates that the orientation of the tube support plate 32 be reversed and the enlarged portion 34*a* be disposed downwardly to the end that water circulation through the tube holes 34 and, thus, sludge removal may be improved. As illustrated in FIGS. 2, 5 and 6, the outer diameter of the tubes 30 is of substantially the same inner diameter as presented by the contact areas 42 of the lands 36, whereby the diametral clearances between the tubes 30 and the contact areas 42 of the lands 36 may be significantly reduced. Thus, the degree of tube vibration is significantly reduced and tube life improved.

Figure 3:
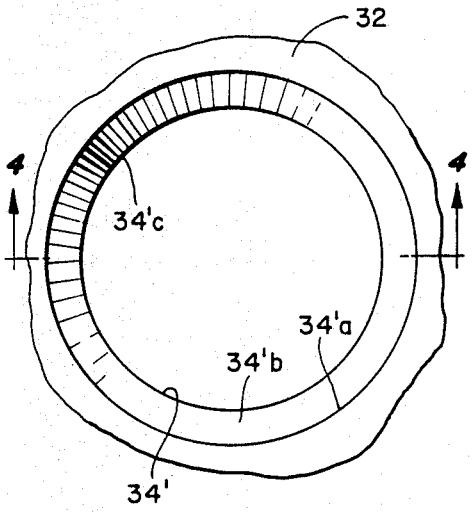
Figure 4:
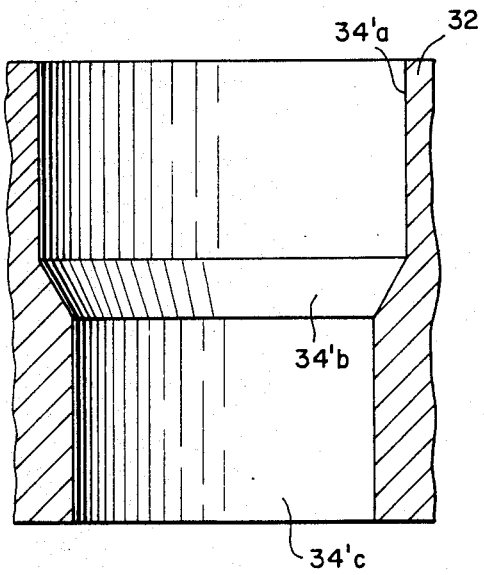
FIGS. 4 and 6 are sectioned views taken along lines 4—4 and 6—6 of FIGS. 3 and 5, respectively.

Referring now to FIGS. 3, 4, 5 and 6, a preferred method of forming the tube holes 34 within the tube support plate 32 will be described. The first step is a drilling operation with a stepped-diameter drill. An upper portion of the drill is of a relatively large diameter corresponding to the enlarged portion of 34*a* of the tube hole 34, and a lower portion is of reduced diameter corresponding to the constricted portion 34*c*. A taper exists between the upper and lower portions of the drill. In an illustrative embodiment of this invention, the upper portion of the drill is 0.923/0.918 inches in diameter and the lower portion of the drill is 0.760/0.758 inches in diameter; a ¼ inch taper exists between the upper and lower drill portions. The first, drilling operation forms an initial opening 34′ in the tube support plate 32 as shown in FIGS. 3 and 4. The upper portion of the drill makes an opening 34′*a* of a relatively large diameter, whereas the lower portion of the drill makes an opening 34′*c* of a lesser diameter. The openings 34′*a* and 34′*c* are separated by a tapered portion 34′*b*. The upper, larger diameter drill removes a significant amount of material, which would normally have to be removed by a subsequent operation, but leaves intact the straight, load carrying portion of the ligaments 38 separating the tube holes 34. Next, the holes 34 are broached, whereby the lobes 40*a, b, c* and *d* are formed with the lands 36*a, b, c* and *d* disposed therebetween. In an illustrative embodiment of this invention, the broach may be dimensioned to provide openings 34 having a diagonal measurement of 1.098/1.094 inches and a side measurement of 0.762/0.760 inches. Finally, the contact areas 42*a, b, c* and *d* are finished by wire brushing.

Thus there has been shown a new and improved tube support plate that overcomes the significant problems of the prior art. First, the length of the lands 36 as taken along the hole axis and their contact areas 42 is reduced. The reduced length of the lands 36, as well as the use of the tapered portions 34b, facilitates the ease with which tubes 30 may be disposed within the tube holes 34, as explained above. The ease of tube insertability is not provided at the expense of the structural strength of the tube support plate 32, which is maintained at a relatively large thickness as taken along the hole axis, whereby the loading capacity as dependent on the cross-sectional area of the ligaments 38 is kept relatively great. Further, the reduction in the land length permits a decrease of the diametral clearances between the tubes and the holes of the tube support plate, whereby tube vibration is decreased and expected tube life increased. As an additional benefit, the reduction of the land length confines the stream or flow of secondary water through each of the tube holes, whereby the flow region downstream or below the lands, as seen in FIG. 6, is confined and the velocity of the water flow about the contact areas between the tubes and the tube support plate is increased, thus preventing the build-up of sludge deposition and vapor blanketing; as a result, tube corrosion is reduced and tube life further extended.

In considering this invention, it should be remembered that the present disclosure is illustrative only and the scope of the invention should be determined by the appended claims.

I claim as my invention:

1. A tube support plate for supporting a plurality of tubes with reduced vibration in a nuclear steam generator, said support plate being of a solid construction and having a plurality of holes disposed therethrough in a regular array, each of said holes having an axis, an interior surface and a plurality of lands supported on said interior surface, said support plate having a given thickness as taken along said axis, each of said lands is disposed substantially parallel with and extends towards its hole axis, whereby a drop in the fluid flow rate through said holes is minimized each of said lands has at its exposed end a contact surface disposed toward said axis for supporting one of the tubes and a height taken along said axis less than said given thickness.

2. The tube support plate as claimed in claim 1, wherein each of said contact surfaces is substantially flat.

3. The tubes support plate as claimed in claim 1, wherein said regular array includes first and second lines disposed perpendicular to and intersecting each other to form points of intersection, said holes disposed at said points of intersection and forming a ligament within said tube support plate between adjacent holes.

4. The tube support plate as claimed in claim 3, wherein each of said lands is disposed within its hole to lie immediately adjacent a land of an adjacent tube hole as taken along one of said first and second lines.

5. A tube support plate for supporting a plurality of tubes with reduced vibration in a nuclear steam generator, said support plate being of a solid construction and having a plurality of holes disposed therethrough in a regular array, each of said holes having an axis, an interior surface and a plurality of lands supported on said interior surface, said support plate having a given thickness as taken as taken along said axis, each of said lands is disposed substantially parallel with and extends towards its hole axis, each of said lands has at its exposed end a contact surface disposed toward said axis for supporting one of the tubes, a height taken along said axis less than said given thickness and at least one end tapered from said contact surface to said interior surface facilitating the insertion of a tube through said hole.

* * * * *